United States Patent [19]

Kosal

[11] 3,967,631

[45] July 6, 1976

[54] FINGERNAIL CAP

[76] Inventor: Kathleen M. Kosal, 8900 E. Jefferson, Apt. 612, Detroit, Mich. 48214

[22] Filed: Jan. 17, 1975

[21] Appl. No.: 541,942

[52] U.S. Cl. ..... 132/73

[51] Int. Cl.[2] ..... A45D 29/00

[58] Field of Search ..... 132/73, 79; 128/157, 128/77; 15/104

[56] References Cited

UNITED STATES PATENTS

| | | | |
|---|---|---|---|
| 1,231,270 | 6/1917 | Knudsen | 132/73.5 |
| 1,879,609 | 9/1932 | Hannon | 128/77 |
| 1,917,794 | 7/1933 | Brown | 128/77 |
| 2,072,683 | 3/1937 | Niedorff | 128/77 |
| 2,199,207 | 4/1940 | Nolan | 132/73 |

*Primary Examiner*—G.E. McNeill

*Attorney, Agent, or Firm*—Clarence A. O'Brien; Harvey B. Jacobson

[57] ABSTRACT

A fingernail cap having a band which is engageable on the terminal phalanx of a finger and is supportively connected to a shell provided with a cavity arrangeable over the nail and tip of the finger for protectively encasing same and protecting the fingernail from dirt, breaking, cracking, and the like.

1 Claim, 6 Drawing Figures

FINGERNAIL CAP

BACKGROUND OF THE INVENTION

1. Field of the Invention

This invention relates generally to a protective cap or guard, and particularly to a fingernail cap which protects a fingernail from dirt, breaking, cracking, and the like.

2. Descripton of the Prior Art

A commonly encountered problem is that of breaking and tearing fingernails, not to mention the usual accumulation of dirt that regularly must be cleaned from under the nails. These problems are aggravated for women who conventionally wear their fingernails relatively long, in accordance with the fashion, and paint their nails with a lacquer or enamel which requires time to dry. As a consequence, women frequently find it difficult to accomplish routine tasks such as housework, gardening and yard work, typing, baking and cooking, applying cosmetics and arranging their hair, and other general activities without harming their fingernails.

Numerous appliances have been proposed for protecting fingernails from the aforementioned hazards. Examples of such appliances may be found in U.S. Pat. Nos. 2,225,571, issued Dec. 17, 1940 to J. E. Smith; 2,323,854, issued July 6, 1943 to S. Silverman; 2,458,709, issued Jan. 11, 1949 to J. H. Kayer; and 3,070,804, issued Jan. 1, 1963 to S. C. Parrilla. These known devices generally have a shield that extends from a finger-encompassing band and covers only the surface of the fingernail. U.S. Pat. No. 2,458,709 uses a fingertip engaging portion in the form of connected side strips that engage between the fingernail and the adjacent fingertip to hold the protector aligned with the end phalanx of the finger, while U.S. Pat. No. 3,070,804 has a nail supporting strip which forms a similar function. These known appliances have in common, that they are only concerned with protecting the fingernail per se, and thus only protect the top, or outer, surface of the fingernail.

Other references believed pertinent to the present invention are as follows:

| | | |
|---|---|---|
| 1,783,984 | M.V. Shape | 12/9/30 |
| 2,816,555 | C.A. Klump | 12/17/57 |

SUMMARY OF THE INVENTION

It is an object of the present invention to provide a fingernail protecting device which affords greater protection to a fingernail than previous devices of this kind.

It is another object of the present invention to provide a fingernail protective device that affords complete protection to the fingernail, while leaving the fingers themselves free to perform conventional tasks.

These and other objects are achieved according to the present invention by providing a fingernail cap having: a shell engageable on the third, or terminal, phalanx of a finger, the shell being connected to a band which grips the finger and provided with a cavity arrangeable over a nail and tip of the finger for encasing the nail and tip of the finger.

The shell advantageously has a tip spaced from the associated band, and a window is provided in the shell between the shell tip and the band. The nail and tip covering portion may be provided with edges defining the window in such a manner that the window is arrangeable adjacent a pad of an associated finger. The edges of the nail and tip covering portion are desirably engaged with the finger for completely encasing the nail and tip of the finger within the shell.

While the shell-supporting band may be a continuous ring, it is advantageous to construct the band in the form of a split ring of a resilient material and forming a pair of cooperating straps. Each of the straps is advantageously provided with a tab arranged in a common plane with the tab of the other of the straps, with the straps normally cooperating with one another to form a continuous surface around the band.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
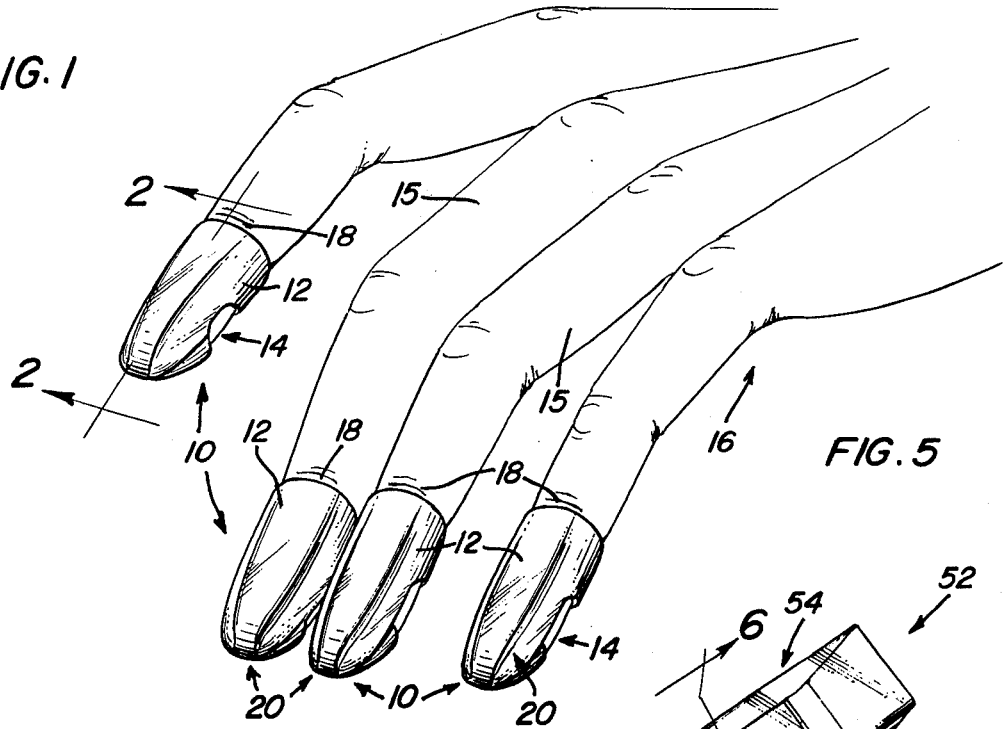
FIG. 1 is a fragmentary, perspective view showing each finger of a human hand provided with fingernail caps according to the present invention.

Referring now more particularly to the embodiment of the invention shown in FIGS. 1 through 4 of the drawings, fingernail caps 10 each have a band 12 engageable on the third, or terminal, phalanx 14 of a finger 15 of a human hand 16. It will be appreciated that while the four fingers of a hand are shown in FIG. 1 as provided with fingernail caps 10, any number of the fingers may be so provided, and also the thumb (not shown) if so desired. Further, both of a person's hands may have the finger and thumb nails thereof protected by fingernail caps 10. As perhaps can best be seen from FIG. 2 of the drawings, band 12 extends onto phalanx 14 up to the joint 18 articulating phalanx 14 to the adjoining second phalanx. Band 12 is an extension of a shell 20 provided with a cavity 21 arrangeable over a fingernail 22 and an associated fingertip 24 of the finger 15 for encasing the nail 22 and tip 24.

Shell 20, arrangeable covering nail 22 and tip 24 of a finger 15, is advantageously shaped generally to the contour of the nail 22 and tip 24, and shell 20 is further retained on finger 15 supported by band 12 spaced from nail 22 and tip 24. Shell 20 is further provided with a tip 26 spaced from band 12. A window 28 is provided in shell 20 between tip 26 and band 12, with window 28 being defined by edges 30 and 32 of shell 20. Window 28 is advantageously arranged adjacent a pad 34 of the associated finger 15, with edges 30, 32 of shell 20 engaging with finger 15 for completely encasing nail 22 and tip 24 of the finger 15, although the window could be arranged adjacent the fingertip, in a manner not shown. The limiting criteria is that the fingernail and adjacent portion of the fingertip be covered so as to encase the entire fingernail.

Band 12 is preferably the illustrated split ring constructed from a suitable, known resilient material, such as cellulose acetate, and forming a pair of cooperating straps 36 and 38. Each of straps 36 and 38 can be provided with a tab 40 and 42, respectively, arranged in a common place with the tab 42, 40 of the other of the straps 38, 36. In this manner, straps 36, 38 normally cooperate with one another to form a continuous surface around band 12. That is, when there is no bias on band 12, straps 36 and 38 will be permitted to come together and tabs 40 and 42 will form, in essence, an interfingering connection. Alternatively, band 12 can be a continuous piece (not shown).

Figure 4:
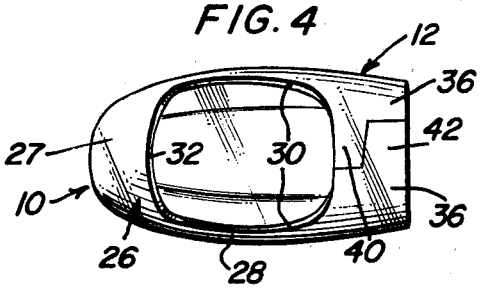
FIG. 4 is a bottom plan view of the fingernail cap of FIGS. 2 and 3.

Referring now more particularly to FIG. 4 of the drawings, fingernail cap 10 has, for example, a substantially square, or "squarish", tip 27. This tip 27 is advantageous in that women are currently shaping their fingernails to a similar shape in order to give the nail additional strength. Also, the shape of tip 27 permits the fingernails to be filed to any shape, such as round, oval, and square. Of course, however, other shaped tips (not shown) may be employed, as desired.

Figure 5:
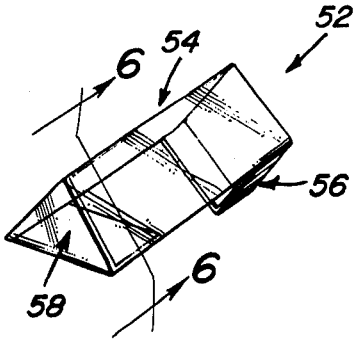
FIG. 5 is a bottom plan view similar to FIG. 4, but showing a modified embodiment of the present invention.
Figure 2:
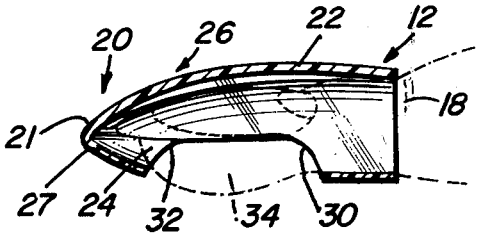
FIG. 2 is a fragmentary, sectional view taken generally along the line 2—2 of FIG. 1.
Figure 3:
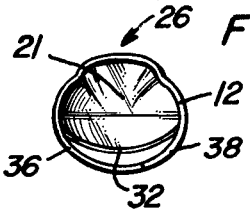
FIG. 3 is a rear elevational view of the fingernail cap of FIG. 2.
Figure 6:
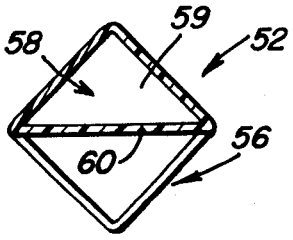
FIG. 6 is a sectional view taken generally along the line 6—6 of FIG. 5.

FIGS. 5 and 6 of the drawings show another embodiment of the present invention in the form of a fingernail cap 52 having a shell 54 of substantially an inverted V-shaped transverse cross section and preferably provided with an adjustable band such as band 56 which allows expansion of the circumference of the band, or an appropriate decrease of same. An angled end piece 58 encloses, and forms, the tip of shell 56, and is formed itself from a triangular portion 59 and a rectangular portion 60 extending perpendicularly from portion 59. Without this end piece a protective nail-shield could also be constructed. It will be appreciated that shell 54 may be molded in a conventional manner from a suitable synthetic material, such as cellulose acetate, so as to have portions 58 molded thereinto, with band 56 being either continuous or split (not shown) as desired.

As will be appreciated from the above description and from the drawings, all embodiments of a fingernail cap according to the present invention advantageously are designed so that the portion of the shell of the cap which will be adjacent the fingernail is spaced, for example, a fraction of an inch from the nail so as to permit the cap to be worn over conditioners, lotions, hardeners, polish, and similar substances applied to the nail. Of course, the fingernail cap according to the present invention acts as a shield to keep fingernails from breaking or tearing while doing cleaning, or other rough work, which requires use of the hands, and will also prevent one from biting their nails. While the fingernail caps may be constructed from any suitable, known material, including metals, it is preferable that they be constructed from a hard, yet somewhat resilient, synthetic material such as cellulose acetate. Thus, while generally rigid, the appliance may have some resiliency, especially in the adjustable bands. In this manner, the band will conform to different size fingers with a firm grip.

A fingernail cap according to the present invention, which may be used on all eight fingers and the two thumbs, makes it possible to work at most tasks and still keep one's fingernails protected from dirt, breaking, cracking, and the like. Some instances when use of fingernail caps according to the present invention would be indicated are as follows:

1. Applying cosmetics and arranging hair.
2. Typing.
3. General housework.
4. Gardening and yard work.
5. Baking and/or cooking. While kneading dough or meat it is possible to wear the caps in order to keep one's fingernails clean and the food free from germs, and the like.
6. Smoking, reading, sleeping, and the like, as well as all general activities.

The fingernail caps according to the invention also protect fingernails and, for example, lacquer on the nails until the lacquer has hardened and dried. Further, the fingernail caps act as a protector for various lotions and conditioners usually employed on fingernails and fingertips.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fingernail and finger tip cap, comprising, in combination:

a. a longitudinally elongated, generally tubular shell constructed of generally rigid but resilient material and having a longitudinal slit defining means therein, said shell being provided with a cavity extending throughout the length thereof and having an open end and a closed tip end, said shell being arranged in telescopic relation over a nail and adjacent tip of a finger for encasing and protecting same, the slit defining means extending from the open end of the shell to enable frictional gripping engagement of the shell with the finger on which it is mounted, the tip end of the shell tapering to conform with the contour of the tip end of the finger with the remainder of the shell conforming with the contour of the fingernail and adjacent portions of the finger; and b. said shell including an imperforate top wall disposed in overlying spaced relation to the fingernail throughout its entirety, the bottom wall of the shell including an opening defining a window exposing the pad of the finger encased by the shell, said opening having a forward edge spaced inwardly from the tip end of the shell for completely encasing the nail and tip of the finger and preventing the tip end of the shell from moving upwardly in relation to the tip of the finger.

* * * * *